US006685069B2

(12) United States Patent
Ladd

(10) Patent No.: US 6,685,069 B2
(45) Date of Patent: Feb. 3, 2004

(54) SHOULDER PROTECTION DEVICE FOR USE WHEN CARRYING A LADDER

(76) Inventor: David Ladd, 4640 Flame Ct., St. Louis, MO (US) 63129

( * ) Notice: Subject to any disclaimer, the term of this patent is extended or adjusted under 35 U.S.C. 154(b) by 35 days.

(21) Appl. No.: 09/874,651

(22) Filed: Jun. 5, 2001

(65) Prior Publication Data

US 2002/0179657 A1 Dec. 5, 2002

(51) Int. Cl.[7] ..... A45F 3/10
(52) U.S. Cl. ..... 224/265; 224/270; 224/907
(58) Field of Search ..... 224/264, 265, 224/270, 642, 643, 907

(56) References Cited

U.S. PATENT DOCUMENTS

| | | | | | |
|---|---|---|---|---|---|
| 2,385,315 | A | | 9/1945 | Vanasse | 2/2 |
| 4,474,386 | A | | 10/1984 | Kanemaki | 280/289 |
| D298,386 | S | * | 11/1988 | Hirahara | 224/264 |
| D302,748 | S | * | 8/1989 | Dubeck et al. | D29/122 |
| 4,858,801 | A | | 8/1989 | Sameniego | 224/264 |
| 4,887,318 | A | * | 12/1989 | Weinreb | 2/268 |
| 5,058,789 | A | | 10/1991 | Piper | 224/265 |
| 5,207,364 | A | | 5/1993 | Johnson | 224/264 |
| 5,620,234 | A | * | 4/1997 | Gunby | 297/482 |
| 6,189,753 | B1 | | 2/2001 | Perry | 224/264 |
| 6,267,280 | B1 | * | 7/2001 | Silagy | 2/268 |
| 6,378,746 | B1 | * | 4/2002 | Miller | 224/158 |

* cited by examiner

*Primary Examiner*—Stephen K. Cronin
(74) *Attorney, Agent, or Firm*—Bryan Cave LLP

(57) ABSTRACT

A shoulder protection device for carrying a ladder on the shoulder of a carrier. The protection device includes a resilient cushion having at least one slot extending therethrough and at least one releasable strap extending through the slot. The releasable strap may be wrapped around the ladder to secure the resilient cushion in place such that the resilient cushion is in contact with the shoulder of the carrier.

3 Claims, 2 Drawing Sheets

SHOULDER PROTECTION DEVICE FOR USE WHEN CARRYING A LADDER

FIELD OF THE INVENTION

The present invention relates generally to protective equipment and, more particularly, to a shoulder protection device for use when carrying a ladder.

BACKGROUND OF THE INVENTION

Ladders are heavily used in certain industries such as in construction and related trades. On certain construction sites, a person may be required to frequently carry the ladder from one location to the next, such as from a vehicle onto the construction site, or from place to place within the construction site. It is desirable to allow the carrier to transport the ladder in comfort and without injury. This may be difficult, especially with large extension or step ladders which, although formed from relatively light weight materials, nonetheless exert significant weight and pressure on the carrier's shoulder or collar bone and surrounding tissues and muscles. The weight of the ladder and the portions of the ladder which rest on the carrier's shoulder may cause discomfort and injury, especially if the ladder is large or must be transported over long distances.

When a person transports a ladder (e.g., a folding fiberglass or aluminum step ladder) from place to place, the person typically orients the ladder horizontally, puts an arm through the space between two of the ladder's rungs, and balances the ladder on his shoulder. Depending on the size and configuration of the ladder, it may be difficult to adequately balance the ladder and transport it without the risk of the ladder accidentally sliding on the carrier's shoulder.

A need exists, therefore, for a shoulder protection device that can be removably attached to ladders for protecting one's shoulder when carrying a ladder over the shoulder. The shoulder protection device preferably would aid the carrier in transporting the ladder with as little strain and discomfort as possible.

SUMMARY OF THE INVENTION

The present invention includes a shoulder protection device for carrying a ladder on the shoulder of a carrier. The protection device includes a resilient cushion having at least one slot extending therethrough and at least one releasable strap extending through the slot. The releasable strap may be wrapped around the ladder to secure the resilient cushion in place such that the resilient cushion is in contact with the shoulder of the carrier. In one embodiment of the invention, the resilient cushion is formed from an upper portion and a lower portion such that the at one or more slots are formed between the upper and lower portions. The shoulder protection device is preferably shaped for use with a ladder that has a pair of U-shaped side rails with rungs therebetween. The resilient cushion (e.g., a foam cushion) is preferably sized to fit snugly within one of the U-shaped side rails. The releasable straps then wrap around the ladder to secure the resilient pad in place within the U-shaped channel of the ladder.

BRIEF DESCRIPTION OF THE DRAWINGS

These and other features, aspects, and advantages of the present invention will become better understood with regard to the following description, appended claims, and accompanying drawings wherein:

These drawings are provided for illustrative purposes only and should not be used to unduly limit the scope of the present invention.

DETAILED DESCRIPTION OF THE INVENTION

Figure 1:
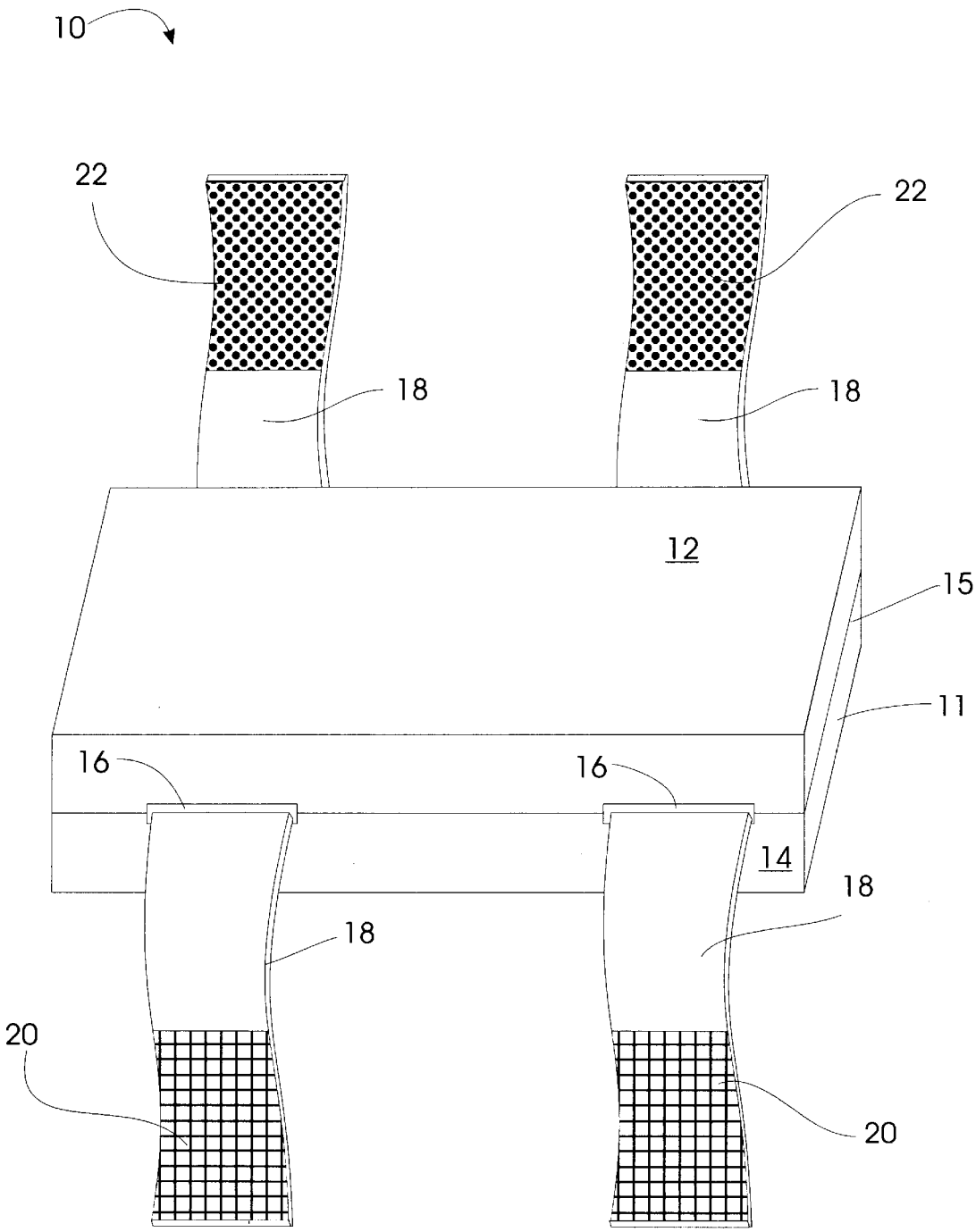
FIG. 1 is a prospective view of a shoulder protection device in accordance with the present invention.

FIG. 1 illustrates one embodiment of a shoulder protection device 10 in accordance with the present invention. The protection device 10 includes a resilient cushion 11 that may be generally rectangularly shaped and formed from a lightweight material having sufficient strength to support the weight of the ladder on the carrier's shoulder. The cushion 11 may be formed, for example, from a foam material such as a conventional closed cell foam. In one embodiment, the cushion 11 may be dipped covered in vinyl in order to protect the cushion 11 from environmental damage, heat, spills, etc. The cushion 11 may be contoured to provide a concave surface for engagement with the shoulder of a carrier. The cushion 11 is generally sized to fit snugly within a channel of a side rail of a ladder, as discussed below.

The resilient cushion 11 includes one or more slots 16 through which straps 18 may pass to secure the protection device 10 onto the ladder. In one embodiment, the resilient cushion 11 may be formed from two separate portions, namely, upper portion 12 and lower portion 14 attached together at seam 15. The upper portion 12 and lower portion 14 may be attached using any number of means including gluing using a construction grade adhesive. The slots 16 may be formed in the two-piece cushion 11 as areas where the surfaces of the upper portion 12 and lower portion 14 are not adhered together. Alternatively, if the cushion 11 is formed from a single piece of material, the slots may be cut through the resilient cushion 11. The straps 18 may fit snugly within the corresponding slots 16. Alternatively, the straps 18 may be fixedly attached to the cushion 11 such that the straps do not slide within the slots 16 during use.

The shoulder protection device 10 preferably includes means to selectively attach and detach the device 10 from the frame of a ladder. The straps 18 may include releasable fasteners 20, 22, such as, for example separable hook and loop type fasteners (e.g., Velcro® brand fasteners) so that the protection device 10 can be readily installed and removed as desired and so that the shoulder protection device 10 may be used with ladders having various dimensions and configurations. Preferably, the shoulder protection device 10 includes two straps 18 that are spaced apart from one another to accommodate a pivotally mounted cross brace of the ladder. The straps 18 allow the carrier to mount the protection device 10 in a variety of different positions on the ladder according either to the form of the ladder or the preference of the carrier. The straps 18 also allow the protection device 10 to be detached from the ladder. Of course, the user may also desire to leave the protection device 10 attached to the ladder while the ladder is in use.

Figure 2:
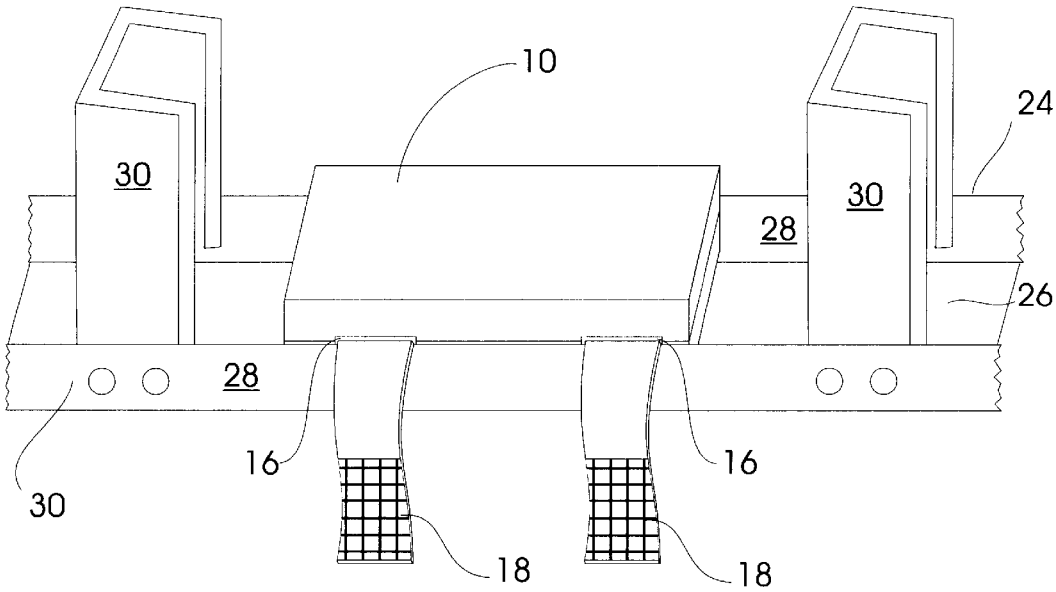
FIG. 2 is a prospective view of the shoulder protection device of FIG. 1 shown attached to a conventional ladder.

FIG. 2 illustrates a section of a side rail 28 of a typical aluminum step ladder 24 having a generally U-shaped cross-sectional configuration defining an inwardly facing channel 26. The side rails 28 have rungs 30 attached between one rail 28 and a corresponding rail 28 on the other side of the ladder (not shown). The resilient cushion 11 is preferably sized to fit within the channel 26 and the straps 18 wrap around the side rails 28 to secure the resilient cushion 11 in place within the U-shaped channel 26 as illustrated in FIG. 2. When disposed within the U-shaped channel 26 of the ladder 24, the upper portion 12 of the resilient cushion 11 extends sufficiently above the surface of the ladder 24 to enable the cushion 11 to deflect upon loading without having the ladder impinge upon the carrier's shoulder.

Thus, the present invention includes a lightweight shoulder protection device that is easy to manufacture and which eases the effort necessary to transport the ladder by distributing the weight of the ladder over a larger area of the carrier's shoulder. The protection device 10 described herein may be used on ladders of a wide variety of different constructions and designs. Although the present invention has been described in considerable detail with reference to certain presently preferred embodiments thereof, other embodiments are possible without departing from the spirit and scope of the present invention. Therefore the appended claims should not be limited to the description of the preferred versions contained herein.

I claim:

1. A ladder comprising a pair of U-shaped side rails with rungs therebetween and a shoulder protection device attached to the ladder for carrying the ladder on a shoulder of a carrier, wherein the protection device comprises a resilient cushion sized to fit snugly within one of the U-shaped side rails and having at least one slot extending therethrough and at least one releasable strap extending through the at least one slot for wrapping around the ladder to secure the resilient cushion in place such that the resilient cushion is in contact with the shoulder of the carrier.

2. The ladder of claim 1 wherein the strap is fixedly attached to the cushion such that the strap does not slide within the slot during use.

3. The ladder of claim 2 wherein the resilient cushion comprises an upper portion and a lower portion, the at least one slot is formed between the upper and lower portions, and the upper portion of the resilient cushion extends sufficiently above the side rail to enable the cushion to deflect without having the rail impinge upon the carrier's shoulder.

* * * * *